US008297020B1

(12) United States Patent
Swanson

(10) Patent No.: US 8,297,020 B1
(45) **Date of Patent: *Oct. 30, 2012**

(54) TOP DOWN TRAP LOCK TWO-PLY SHINGLE SYSTEM FOR ROOFS

(75) Inventor: Lief Eric Swanson, Vero Beach, FL (US)

(73) Assignee: Top Down Siding LLC, Vero Beach, FL (US)

( * ) Notice: Subject to any disclaimer, the term of this patent is extended or adjusted under 35 U.S.C. 154(b) by 345 days.

This patent is subject to a terminal disclaimer.

(21) Appl. No.: 12/509,695

(22) Filed: Jul. 27, 2009

Related U.S. Application Data

(63) Continuation-in-part of application No. 11/960,880, filed on Dec. 20, 2007, now Pat. No. 7,578,108.

(51) Int. Cl.
*E04D 1/00* (2006.01)

(52) U.S. Cl. ..... 52/540; 52/412; 52/518; 52/543; 52/748.1; 156/299; 156/297; 428/130

(58) Field of Classification Search ..... 52/408, 52/409, 410, 411, 412, 413, 478, 518, 519, 52/520, 521, 524, 526, 531, 539, 540, 541, 52/543, 544, 545, 546, 547, 551, 553, 559, 52/748.1, DIG. 16; 428/33, 53, 54, 57, 189, 428/190, 191, 343, 354, 121, 124, 130; 156/71, 156/290, 291, 574, 227, 297, 281, 299, 306.6
See application file for complete search history.

(56) References Cited

U.S. PATENT DOCUMENTS

| | | | | | |
|---|---|---|---|---|---|
| 447,121 | A * | 2/1891 | Stecher | 43/114 |
| 2,667,131 | A * | 1/1954 | Clarvoe et al. | 52/420 |
| 2,863,405 | A * | 12/1958 | Leibrook et al. | 52/420 |
| 3,050,908 | A * | 8/1962 | Schenk | 52/420 |
| 3,180,783 | A * | 4/1965 | Walker et al. | 428/148 |
| 3,252,257 | A * | 5/1966 | Price et al. | 52/518 |
| 3,454,442 | A * | 7/1969 | Heller, Jr. | 156/274.8 |
| 3,616,114 | A * | 10/1971 | Hamaguchi et al. | 428/42.2 |
| 3,895,981 | A * | 7/1975 | Tesch | 156/71 |
| 4,493,175 | A * | 1/1985 | Coppola, Jr. | 52/410 |
| 4,562,104 | A * | 12/1985 | Maeda | 428/148 |
| 4,848,057 | A * | 7/1989 | MacDonald et al. | 52/518 |
| 4,855,172 | A * | 8/1989 | Chiu | 428/57 |
| 4,869,942 | A * | 9/1989 | Jennus et al. | 428/77 |
| 5,021,273 | A * | 6/1991 | Kobayashi | 428/42.1 |
| 5,305,569 | A * | 4/1994 | Malmquist et al. | 52/309.8 |
| 5,347,785 | A * | 9/1994 | Terrenzio et al. | 52/555 |
| 5,388,381 | A * | 2/1995 | Bilinski et al. | 52/519 |
| 5,488,807 | A * | 2/1996 | Terrenzio et al. | 52/555 |
| 5,526,626 | A * | 6/1996 | Loucks | 52/518 |

(Continued)

*Primary Examiner* — Robert Canfield
*Assistant Examiner* — Matthew Gitlin
(74) *Attorney, Agent, or Firm* — Malin Haley DiMaggio Bowen & Lhota, P.A.

(57) ABSTRACT

A top down trap lock shingle system that includes a plurality of identical shingles, each shingle having a bottom layer and a top layer permanently attached to said top edge of said bottom layer forming an extended area along the top of the shingle that includes strips of adhesive and said bottom layer having an enlarged nailing or stapling zone that extends beyond the bottom edge of the top layer. The shingles are trapped locked together by inserting the top tab portion of the top area in a top down manner onto an above shingle row staggered to protect the seams and fastening the bottom edge of the shingle to the plywood roof thus trap locking each of the shingle rows in place. The laminated shingle system is especially durable and provides protection against high winds preventing wind damage and water intrusion.

10 Claims, 11 Drawing Sheets

U.S. PATENT DOCUMENTS

| | | | | |
|---|---|---|---|---|
| 5,571,596 | A * | 11/1996 | Johnson | 428/143 |
| 6,220,329 | B1 * | 4/2001 | King et al. | 156/512 |
| 6,887,515 | B2 * | 5/2005 | Zickell | 427/186 |
| 7,169,247 | B2 * | 1/2007 | Greenhill | 156/227 |
| 7,578,108 | B2 * | 8/2009 | Swanson | 52/540 |
| 2003/0173023 | A1 * | 9/2003 | Zickell | 156/279 |
| 2004/0123545 | A1 * | 7/2004 | Phillips | 52/535 |
| 2004/0148896 | A1 * | 8/2004 | Koch et al. | 52/543 |
| 2005/0262791 | A1 * | 12/2005 | Pringle et al. | 52/540 |
| 2006/0032174 | A1 * | 2/2006 | Floyd | 52/518 |
| 2006/0179767 | A1 * | 8/2006 | Miller et al. | 52/555 |
| 2006/0265990 | A1 | 11/2006 | Kalkanoglu et al. | |

* cited by examiner

TOP DOWN TRAP LOCK TWO-PLY SHINGLE SYSTEM FOR ROOFS

CROSS REFERENCE TO RELATED APPLICATIONS

This application is a continuation-in-part of U.S. patent application Ser. No. 11/960,880, filed on Dec. 20, 2007, now U.S. Pat. No. 7,578,108, the disclosure of which is incorporated herein by reference.

BACKGROUND OF THE INVENTION

1. Field of the Invention

This invention relates generally to protective and aesthetic roofing shingles that cover the roof of a building and, specifically, to a laminated rooting shingle that is durable in high winds and heavy rains. Each shingle has a top insert area and a bottom edge trap lock recess area that receives the top insert area of a lower shingle. The shingles are installed in horizontal rows from the top of a roof peak in a downward direction.

2. Description of Related Art

In the above referred to Applicant's co-pending U.S. application Ser. No. 11/960,880, there is disclosed a top down trap lock shingle system. A single shingle used in the top down system is generally comprised of a base layer of shingle material, an intermediate layer and a top layer of material. The arrangement of the shingles with respect to each other is such that the layers are interlocking from the roof top downward in horizontal rows.

It has now been determined that the principles embodied in the shingle system in U.S. application Ser. No. 11/960,880 may be used to provide a similar top down trap lock shingle system that requires in each shingle only a top layer and a bottom layer, thereby making each panel less costly.

The roofing shingle system described herein provides for a different shingle structure and a different method of attaching the shingles to a roof structure than the prior art to greatly increase the structural integrity and durability of the shingle system even in high winds to prevent water intrusion.

SUMMARY OF THE INVENTION

A shingle comprising a base (bottom) layer and a top layer spaced and strategically joined and laminated to an upper portion of said base layer. The bottom layer has an extended strategically sized area or zone for applying roof fasteners such as nails or staples along its lower base edge. Each shingle has a trap lock recess area between the bottom layer and the top layer that receives the top edge portion of an adjacent lower shingle. Thus, a lower shingle top layer secures and trap locks the lower shingle to the shingle above. The shingle recess area end may also have a strip of flexible mesh webbing for a hinge. The webbing strip is adhered to the top and bottom shingle layers thereby increasing the strength of the bond and flexibility between the top and bottom layers of a shingle. Each shingle includes additional adhesive areas for securely fastening rows of shingles in a top down procedure. By trap locking adjacent rows of shingles, the shingle system has more structural durability and integrity against wind damage to prevent water intrusion.

The top down installation procedure requires that the first row of shingles be placed at the top of the roof area. A ridge cover at the top of the roof on each side may include a shingle having the trap lock recess to receive the top edge of the lower row of shingles. Subsequent rows of shingles are then fastened below the preceding row of shingles and are inserted into a trap lock recess area formed in the above shingle by the base layer and the top layer of each shingle. Each shingle includes a plurality of rectangular tabs or a cutout pattern alternating in tabs and cutouts laterally of the top layer.

One of the important features of the present shingle system is its dramatic increased resistance to wind uplift. The present system also reduces the number of fasteners required or entirely eliminates the use of fasteners. Furthermore, the system may increase the reveal from certain standard areas to larger areas allowing a roof to be covered more quickly, reducing installation time.

The shingle base layer has a wide extending band along the bottom edge that receives fasteners and is called the fastener attachment flange or hem. The fasteners used are typically nails or staples but could be any other suitable fastener. The upper area of the base layer includes a trap lock recess area and an adhesive area. In one embodiment, the shingle recess area contains a flexible poly mesh webbing strip thus providing a hinge which allows for the deflection of the top layer upwardly with respect to the bottom layer to allow the insertion of the upper edge of the next shingle. The hinged area also increases the flexibility of the top layer in relation to the base layer in high winds.

When fastening the rows of shingles to a roof, working from the top of the roof downwardly, each next row of shingles is attached by sliding the upper edge of the shingle (which is basically the top layer top edge) which has an adhesive band into the trap lock recess area along the lower portion of the above shingle that has already been attached to the roof by fasteners. The fasteners are covered by the lower shingle.

The lower shingle is secured within the trap lock recess area with adhesive and the overlap from the top layer. The recess area may be reinforced with a strip of poly flexible mesh webbing that has a crease and is laminated to the top layer and bottom layer which serves to allow the top layer to be deflected upward for installation. Fasteners are then applied to the fastener flange or hem along the base of the shingle, firmly attaching the shingle to the roof below the trap lock recess area. Each row of shingles is inserted into the trap lock recess to the above row along its top edge and fastened along its base.

In another embodiment of the present invention, the surface area of the bottom side of the base layer is coated with an adhesive coating to affix the shingle directly to a roof with adhesive. The adhesive coating is protected by a peel-and-stick film until ready to use. The purpose of the coating is to eliminate the need for nails thereby lowering installation time and cost.

Another embodiment of the invention provides that the base layer is constructed of a thermally insulated material to increase the R factor of the roof which may include UV reflectivity to reflect solar energy away from the roof.

It is an object of this invention to provide a shingle system that provides for applying the shingles in rows in a top down process from the top of the roof causing each of the subsequent shingles to be securely fastened in a trap lock recess area and joined with adhesive or fasteners.

It is another object of this invention to increase shingle durability in spite of high winds, reduce the number of fasteners, and increase the reveal to a larger area allowing the roof to be covered more quickly reducing installation time.

In accordance with these and other objects which will become apparent hereinafter, the instant invention will now be described with particular reference to the accompanying drawings.

PREFERRED EMBODIMENT OF THE INVENTION

Figure 1:
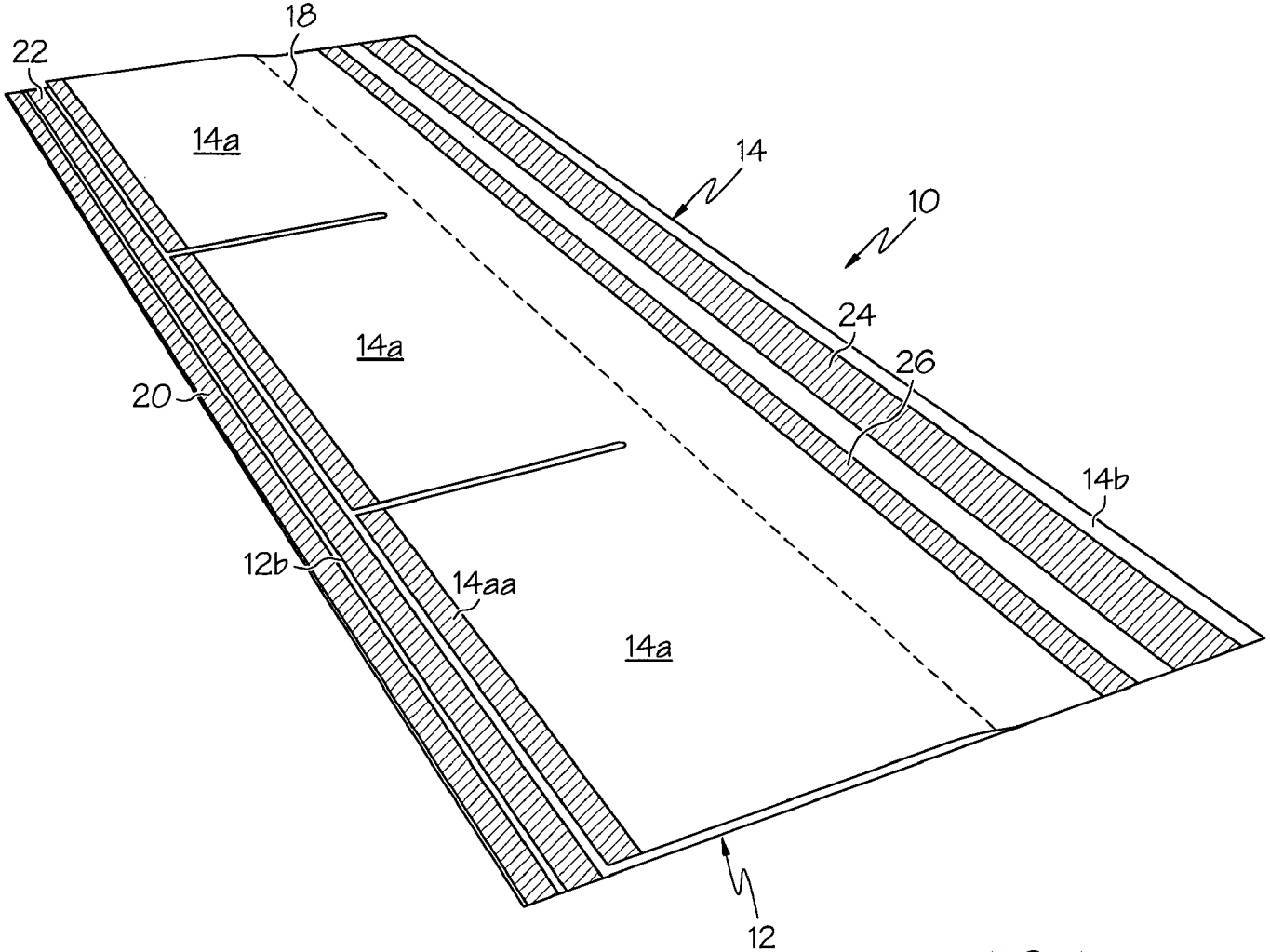
FIG. 1 shows a perspective view of a shingle according to the shingle system of the present invention.
Figure 2:
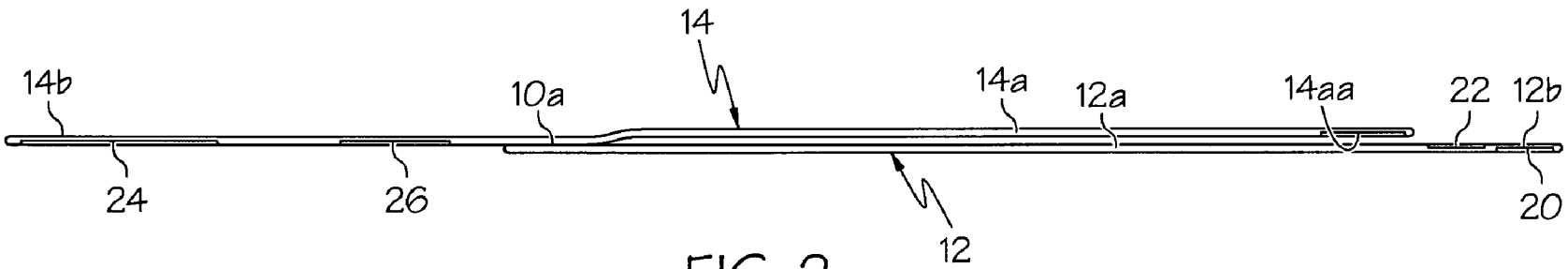
FIG. 2 shows a side elevational view of a shingle according to the present invention.
Figure 3:
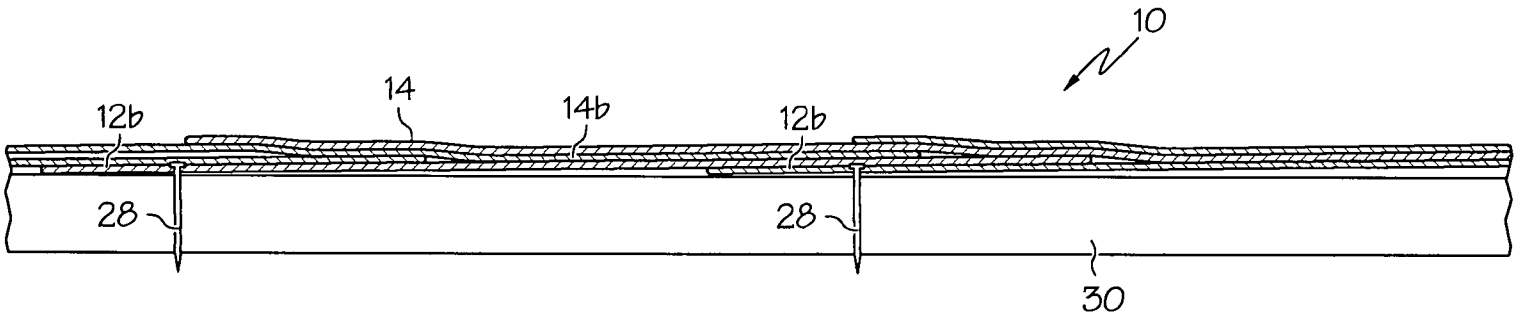
FIG. 3 shows a side elevational view of shingles in a trap lock attached to a roof with nails.

Referring now to the drawings, FIG. 1, FIG. 2 and FIG. 3 disclose a shingle in accordance with the present invention. The shingle 10 is made of asphalt, fiberglass, a composite rooting material or any combination thereof and is comprised of two separate relatively thin, somewhat flexible layers formed in a laminate and permanently glued together or heat scaled together at 10*a* (FIG. 2) as described herein. The shingle 10 is comprised of two layers of materials 12 and 14. Layer 12 is the base or bottom layer and has sections 12*a* and 12*b* which represent different areas on layer 12. Base area 12*b* represents an attachment flange or hem that is used for receiving fasteners to attach the shingle to a roof surface. Layer 14 does not extend along the base over area 12*b* of the lower shingle area. Note that shingle area 12*b* section also has an adhesive band 20 on its underside and an adhesive band 22 on its topside. Adhesive bands or glue strips 14*aa*, 20, 22, 24 and 26 are shown but are not necessarily limited to just these areas. Other embodiments can exist wherein adhesive hand locations can be changed. The adhesive bands are used to attach the upper and bottom shingles more firmly together in a top down pattern. Note that glue strips 24, 26, 14*aa*, and 20 are on the bottom side of the layer and face downwardly. Glue strip 22 is on the top side of the layer and faces upwardly.

The base layer 12 is partially covered by top layer 14 in the form of a three tab 14*a* cutout pattern as shown in FIG. 1. However, the pattern that is cutout is to reduce the amount of material used and to give the shingle system a distinctive shingle-looking pattern. The top layer 14 has tab areas 14*a* which overlap the base layer 12. Top layer 14 has an upper edge area 14*b* that has two glue strips or adhesive strips 24 and 26 on the below side which allow the top layer 14 to be adhesively fastened along its upper edge area in a trap locked recess portion formed between base layer 12 and the top layer 14 of an adjacent upper shingle when the shingles are inserted into an above row of shingles already fastened to the roof.

Figure 2A:
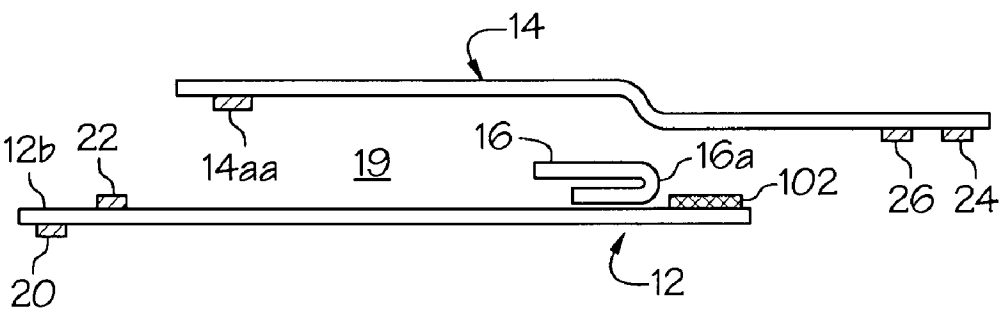
FIG. 2A shows a schematic side elevational view of a shingle according to the invention.

FIG. 2A shows a schematic diagram of how a single shingle is constructed. The top layer 14 is permanently connected to bottom layer 12 along the "x"s 102. This could be either a laminated heat seal or adhesive applied in the factory so that base layer 12 along its top edge is permanently connected at 102 to the top layer 14. In one embodiment, a strip of flexible polyester mesh webbing 16 may be adhered to both the bottom layer 12 and the top layer 14 through a laminating or adhesive process. The mesh webbing strip 16 contains a crease 16*a* running along its horizontal axis which acts as a hinge and allows webbing strip 16 to be bent or folded. The surface area above the crease 16*a* is bonded to the top layer 14. The surface area below the crease 16*a* is bonded to the base layer 12. This strip of mesh webbing 16 forms the trap lock recess 19 that extends from the permanent adhesive 102 between top layer 14 and lower layer 12 as an opening or recess cavity 19 that allows a lower shingle top edge to be inserted partially into the trap lock cavity 19. In addition, the bottom layer 12 is permanently attached to the top layer 14 along adhesive 102. Glue strip 14*aa* faces downwardly.

In FIG. 2A, multiple glue strips are shown including the upward facing glue strip 22 on the upper surface of bottom layer 12, lower glue strip 20 on the lower surface of bottom layer 12, and the glue strips 24 and 26 on the bottom side or the underside of top layer 14. Of course, other glue strips can be added on the upper or lower underneath surfaces for greater adhesion throughout the entire process.

FIG. 3 shows fasteners 28 such as nails that are nailed into a two by tour or plywood sheet 30 along a certain attachment flange area 12*b* of the base layer 12. However, a second shingle is shown having a top edge 14*b* that has been inserted between bottom layer 12 and top layer 14 in an above row shingle causing the lower shingle to be wedged or trap locked into the above shingle along its top edge portion. As shown in FIG. 1, with the glue strips 24 and 26 on the bottom side of top layer 14, when the top layer is in the recess area between bottom layer 12 and top layer 14 of the above row shingle, the glue strips 24 and 26 firmly attach the layer 14 to the lower shingle layer 12. The fasteners 28 along area 12*b* in FIG. 3 firmly secure the base layer of the shingle to the roof.

Referring back to FIG. 3, the upper tab portion 14*b* of a shingle is shown inserted between the upper two laminate layers, the base layer 12 and the top layer 14. The bottom layer 12 has been fastened into a two by four or plywood as shown in FIG. 3.

Note that the bottom layer 12 is permanently bonded to top layer 14 near the registration line 18 that forms the trap lock insert area shown in FIG. 1. The registration line is a visible line used by the shingle installers. Once the shingles are installed properly, the registration line is not visible.

The construction of shingle 10 and its use with other shingles in rows dramatically increase durability and the resistance to wind uplift and water intrusion.

Figure 3A:
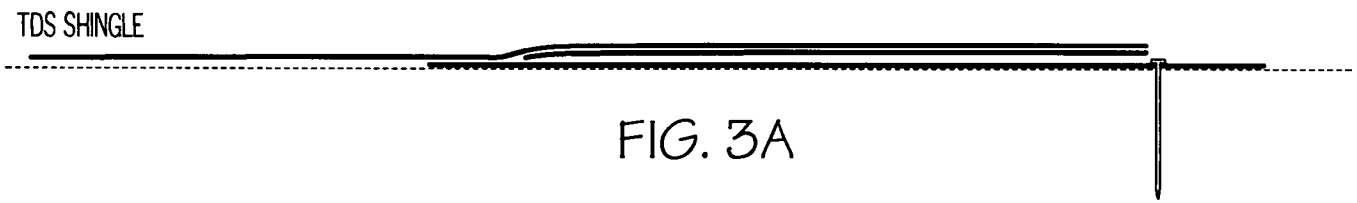
FIGS. 3A and 3B show schematic diagrams in side elevational views of shingles in accordance with the present invention.
Figure 3B:
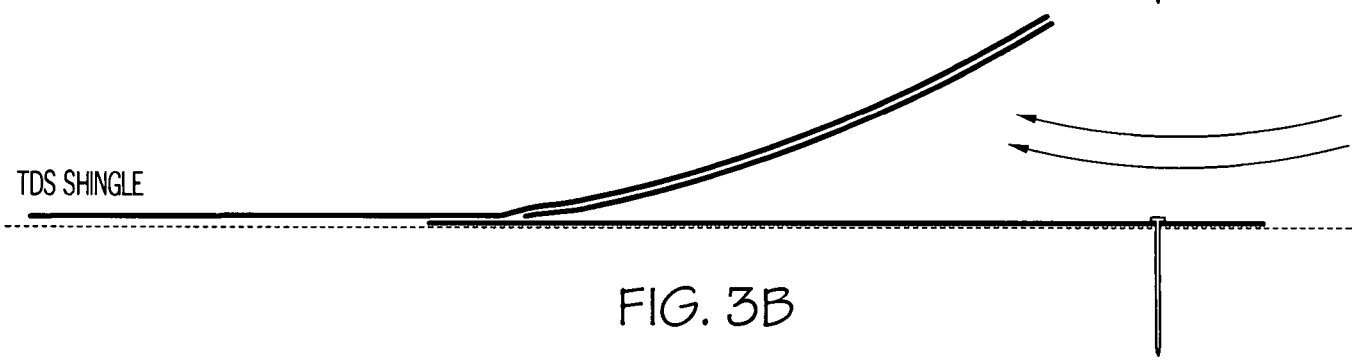
Figure 4A:
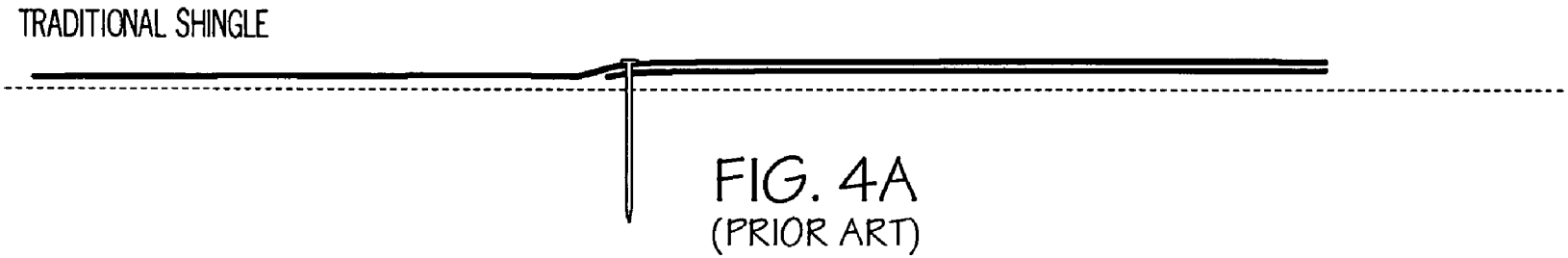
FIG. 4A (PRIOR ART)
FIGS. 4A and 4B show schematic diagrams in side elevational views showing traditional shingles altered by wind.
Figure 4B:
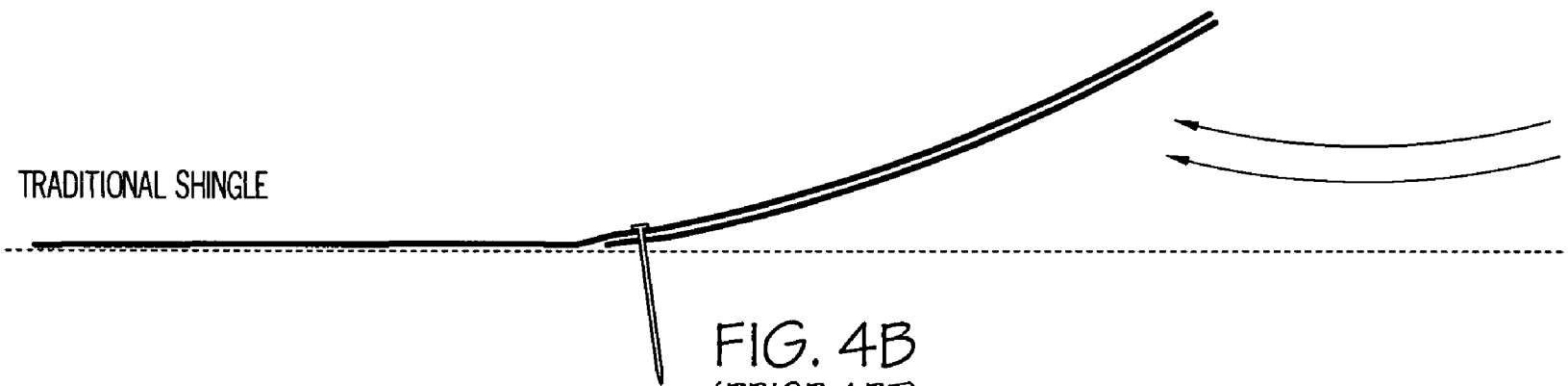
FIG. 4B (PRIOR ART)

Referring now to FIG. 3A, FIG. 3B and FIGS. 4A and 4B, a comparison of a traditional shingle as shown in FIGS. 4A and 4B is made with the present invention as shown in FIGS. 3A and 3B. With the traditional shingle in FIG. 4A, nailed at its top, the wind lifts the shingle like a lever. When looking at the shingle in FIG. 3A and FIG. 3B, it is noted that the upper part of the shingle that is lifted is completely away from the area where the fasteners are along the bottom attachment flange shingle. FIGS. 4A and 4B show prior art conventional shingles that are schematically typically nailed at the top such that the wind indicated by the arrows lifts the shingle up and acts as a lever arm pulling mechanically up on the nail fastener. This cannot happen with the shingle in accordance with the present invention.

Figure 5:
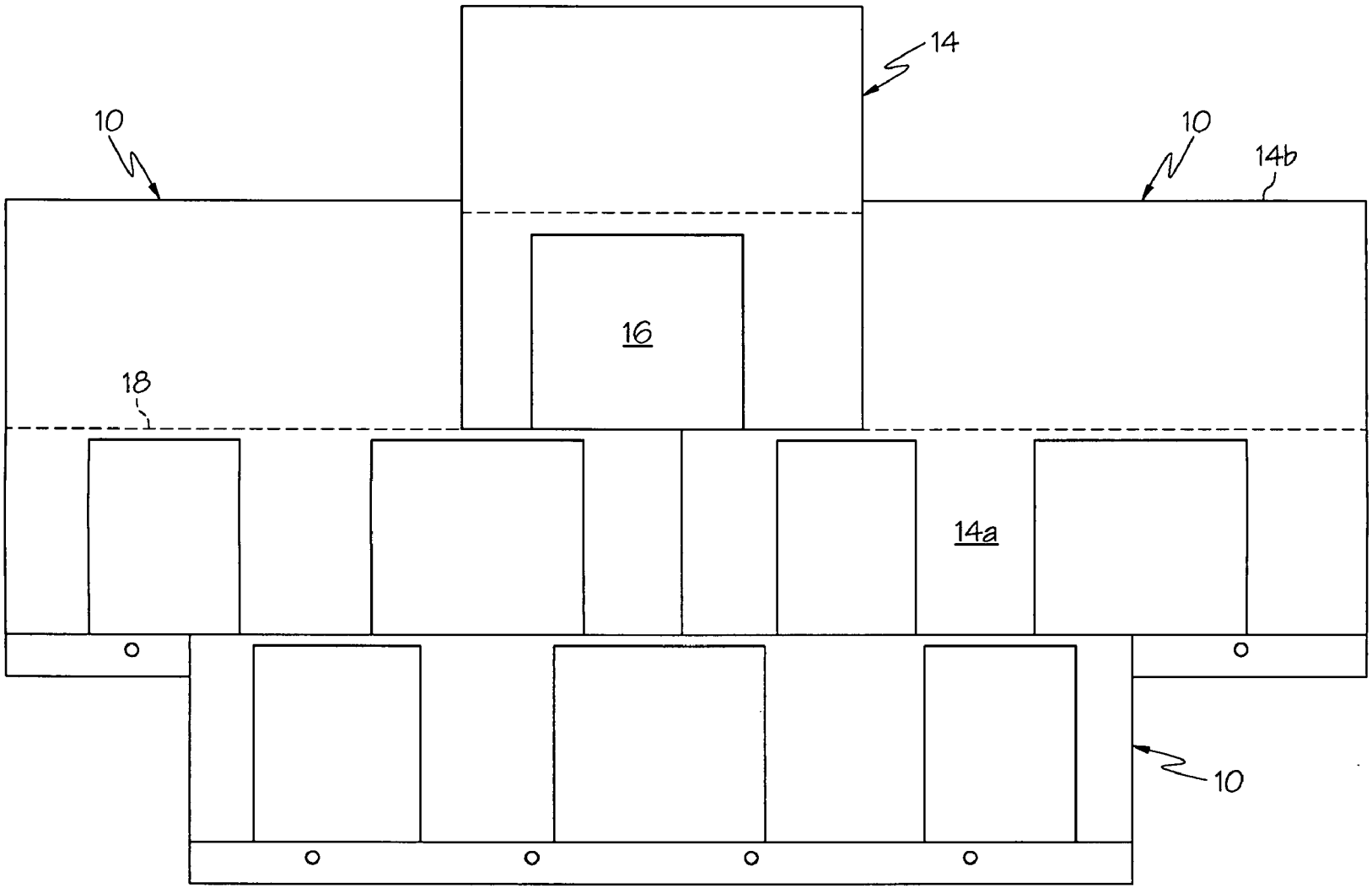
FIG. 5 shows a top plan schematic view representing a plurality of shingles connected together in rows as the shingles would appear installed on a roof surface.

Referring now to FIG. 5, an array of individual shingles is shown as the shingles would be installed in rows on a typical plywood roof. Using the present invention, the top row of shingles are attached at or near the roof ridge (not shown) covered by a ridge shingle (not shown) which could have a trap lock recess area. The installation process is to add the next row of shingles from the top down by inserting the upper tab portion of the shingle 14 into the pocket or recess of the above row of shingles. The seams between shingles in the same horizontal row are done in overlapping fashion relative to the shingles in the above row such that the new row of shingles being installed would be staggered laterally so that the above shingles would cover lateral seams in the lower row. The vertical length of each shingle is constructed so that there is sufficient overlap on the lower panel to prevent any lateral seam exposure or water intrusion along the lateral seam area on each end of each shingle. Each of the shingles could have a registration line 18 as shown in FIG. 1 that is used to ensure that the lower row of shingles is firmly inserted into the pocket in the trap lock formation so that the registration indicator line 18 is not visible to the installer when the shingles are properly installed.

Figure 6:
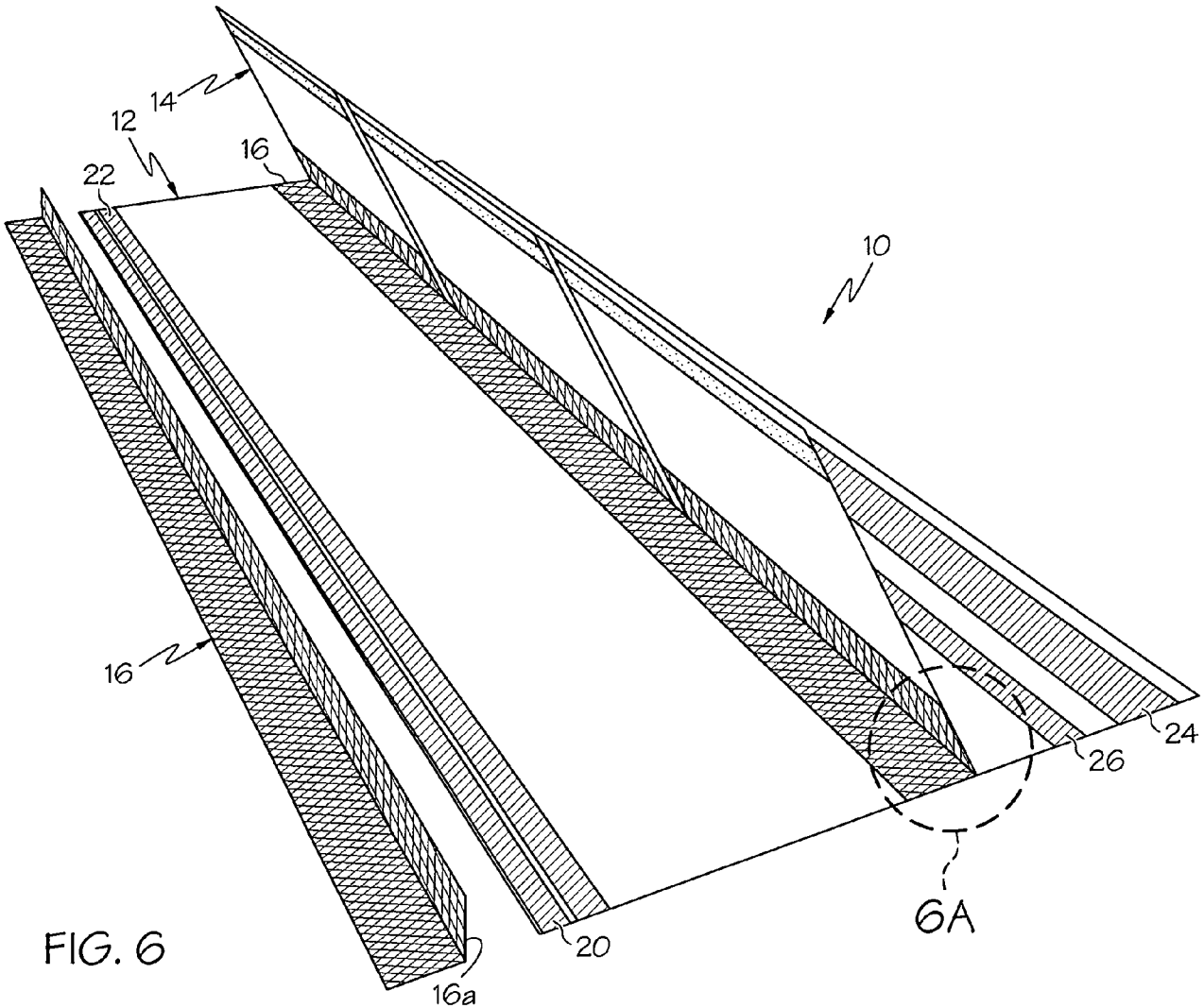
FIG. 6 shows an exploded perspective view of a shingle according to the shingle system in which a strip of flexible poly mesh webbing is both connected and exploded apart from the shingle and the top layer of the shingle is deflected upwards.
Figure 6A:
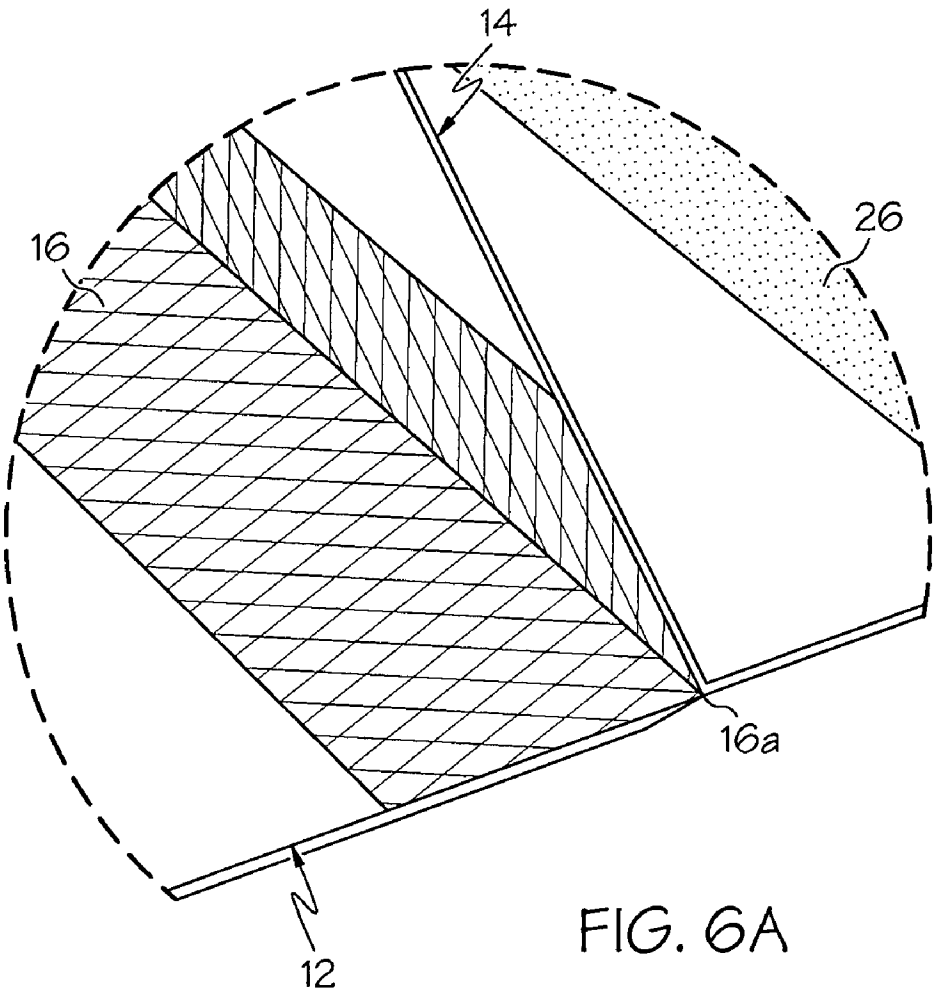
FIG. 6A shows a close up insert, partially cut away view of the flexible mesh webbing strip affixed into place at the trap lock recess connecting the top layer and the bottom layer of a shingle.

FIG. 6 shows an exploded view of a shingle 10 in an alternate embodiment that includes a base or bottom layer 12 and the upper or top layer 14 that are hinged together permanently by a strip of polyester mesh webbing forming a hinge joint 16 (also shown exploded) made of a polyester type mesh material that has longitudinal strength to prevent the bottom panel 12 from separating from the upper layer 14 regardless of the wind and rain conditions. In the typical application shown in FIG. 6 and the enlarged insert FIG. 6A, the poly mesh strip 16 may be rectangular and have a crease 16*a*. The poly mesh strip 16 is adhesively attached at the intersection of the upper layer 14 and the bottom layer 12 to allow some hinge movement while having sufficient strength in the polyester mesh material and the adhesive to prevent separation between the top layer 14 and bottom layer 12. The poly mesh strip 16 is adhesively attached to a top portion of bottom layer 12 and the lower end portion of the upper panel 14 allowing 14 to be hingeably attached to the lower panel 12. The purpose of using the poly mesh strip 16 is to create a hinge joint of superior strength that will not allow the upper panel 14 to separate in high wind conditions to add extra strength to the hinge joint. Other materials other than polyester could be used as the meshed hinge joint as long as the hinge material is strong and has flexibility to prevent separation of the upper layer and lower layer of each shingle.

As Shown in FIGS. 1 and 2, the adhesive strips or bands on shingle 10 are very important for normal locking and trap locking each row of shingles to the row of shingles above along with the attachment flange. Each shingle, as shown in FIG. 1, has two strips of adhesive 24 and 26 which are on the underside of tab 14*b* which is the upper top edge of the shingle and of the top layer of the laminate. This tab edge fits securely in and on top of the upper row of shingles in the pocket formed between the base layer 12 and the top layer 14 that is substantially deep enough or long enough to receive a tab 14*b* portion of the lower shingle including the adhesive bands 24 and 26 allowing the tab portion of the shingle to be firmly glued to the bottom layer 12 which itself is fastened along the attachment flange at its bottom edge 12*b*. Again, the fastening flange has adhesive bands, one facing upwardly and the other 20 facing downwardly on the underside. The upper adhesive band or strip 22 thus becomes glued to the tab upper edge of a lower shingle. The lower adhesive band 20 on the attachment flange 12*b* is glued to the roof surface.

Looking at FIGS. 1, 2, and 3 it is evident that when the shingles are inserted into the trap lock pockets, row by row, in conjunction with the adhesive strips and fasteners, the structural durability and integrity of the shingle is extremely strong against high winds from deforming the shingles or exposing the shingles to water intrusion. Using the trap lock recess pocket in conjunction with the adhesives, the top down roof system made with the shingles is very resistant to wind and water intrusion.

Figure 7:
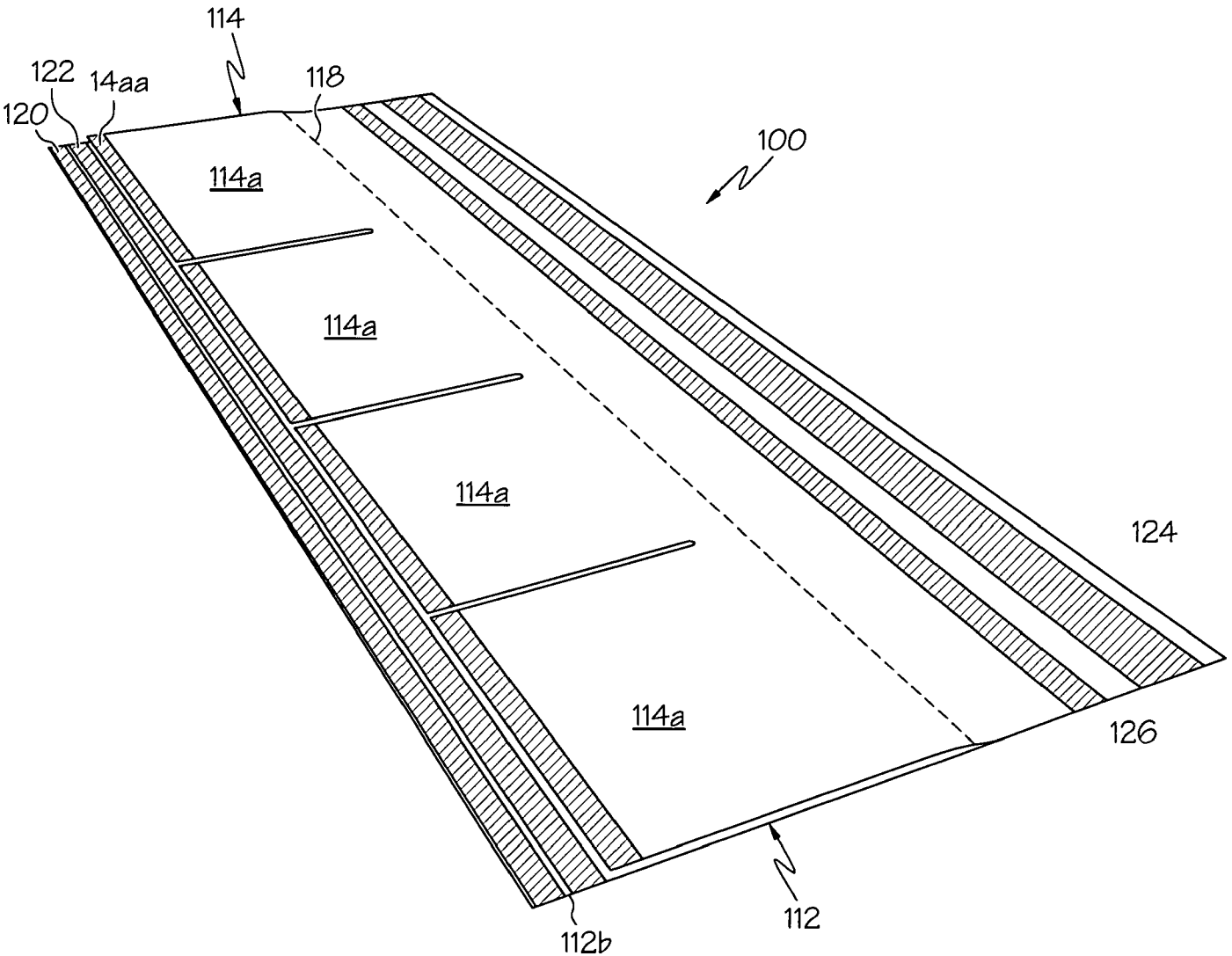
FIG. 7 shows a perspective view of a four tab shingle similar in construction to the three tab shingle shown in FIG. 1.

Referring now to FIG. 7, a four tab shingle 100 is shown. The significance of the construction is that the shingle shows four separate tabs labeled 114*a* as portions of the top layer instead of the three tab shingle shown in FIG. 1. The remaining adhesive strips 120. 122, 114*aa*, 124 and 126 and upper layer 114 and lower layer 112 are constructed the same as the embodiment shown in FIG. 1.

Figure 8:
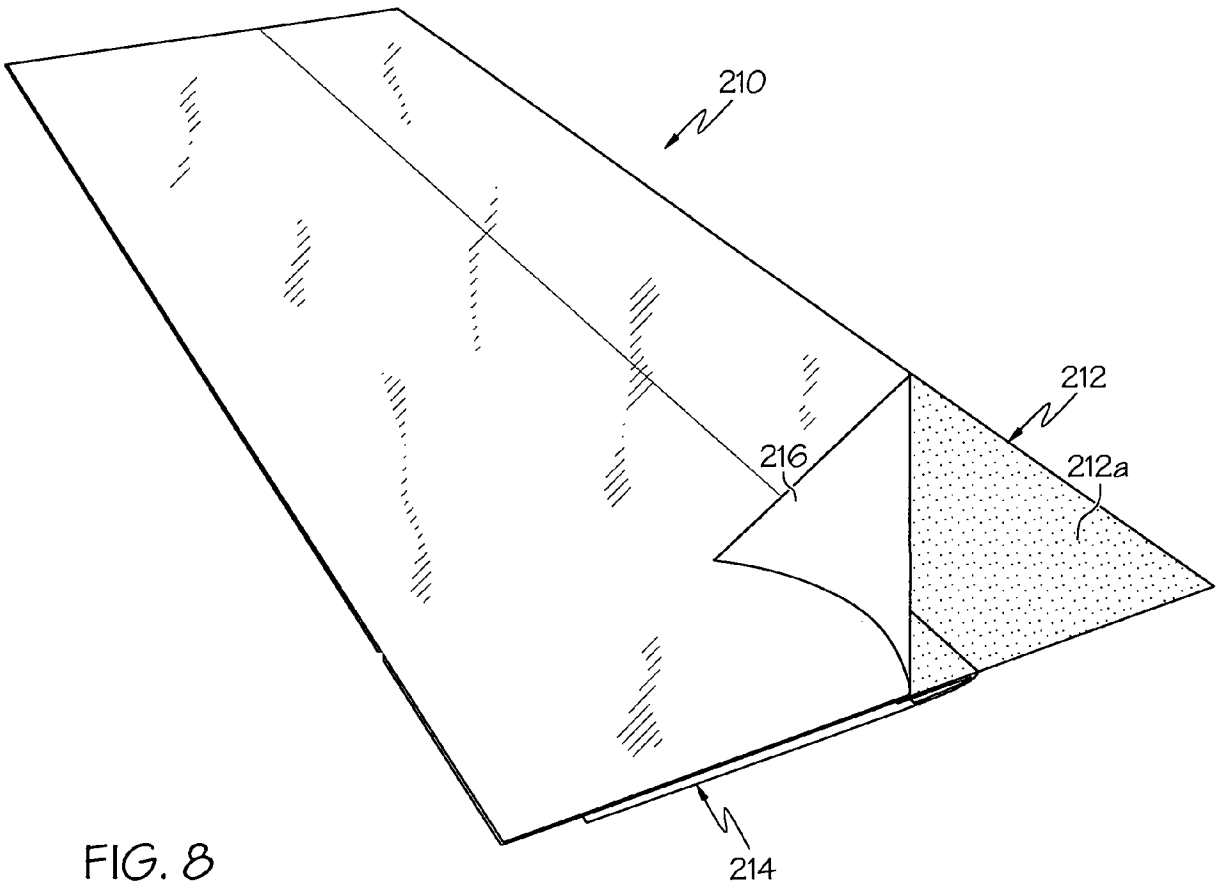
FIG. 8 shows an upside-down perspective view of an alternative embodiment of a shingle according to the shingle system in which the bottom surface of the shingle base layer is coated with a roof adhering adhesive that is protected by a peel-and-stick film that is removed at the time of use when the shingle is adhered to the roof surface by adhesive.

Referring now to FIG. 8, shingle 210 represents another embodiment of the present invention in which the surface area of the bottom side of the base layer 212 is coated with a roof adhesive coating 212*a* which is protected by a peel-and-stick film 216 until ready for shingle attachment to a roof surface. The purpose of the adhesive coating 212*a* is to affix each shingle to a roof surface to eliminate the need for nails, thereby lowering installation time and cost. The purpose of the peel-and-stick film 216 is to keep the adhesive coating protected until the shingle is to be installed on a roof. The shingle 210 includes a top layer 214 and is constructed as the shingles shown in FIGS. 1-3 except for the adhesive backing 212*a* and film 216.

Figure 9:
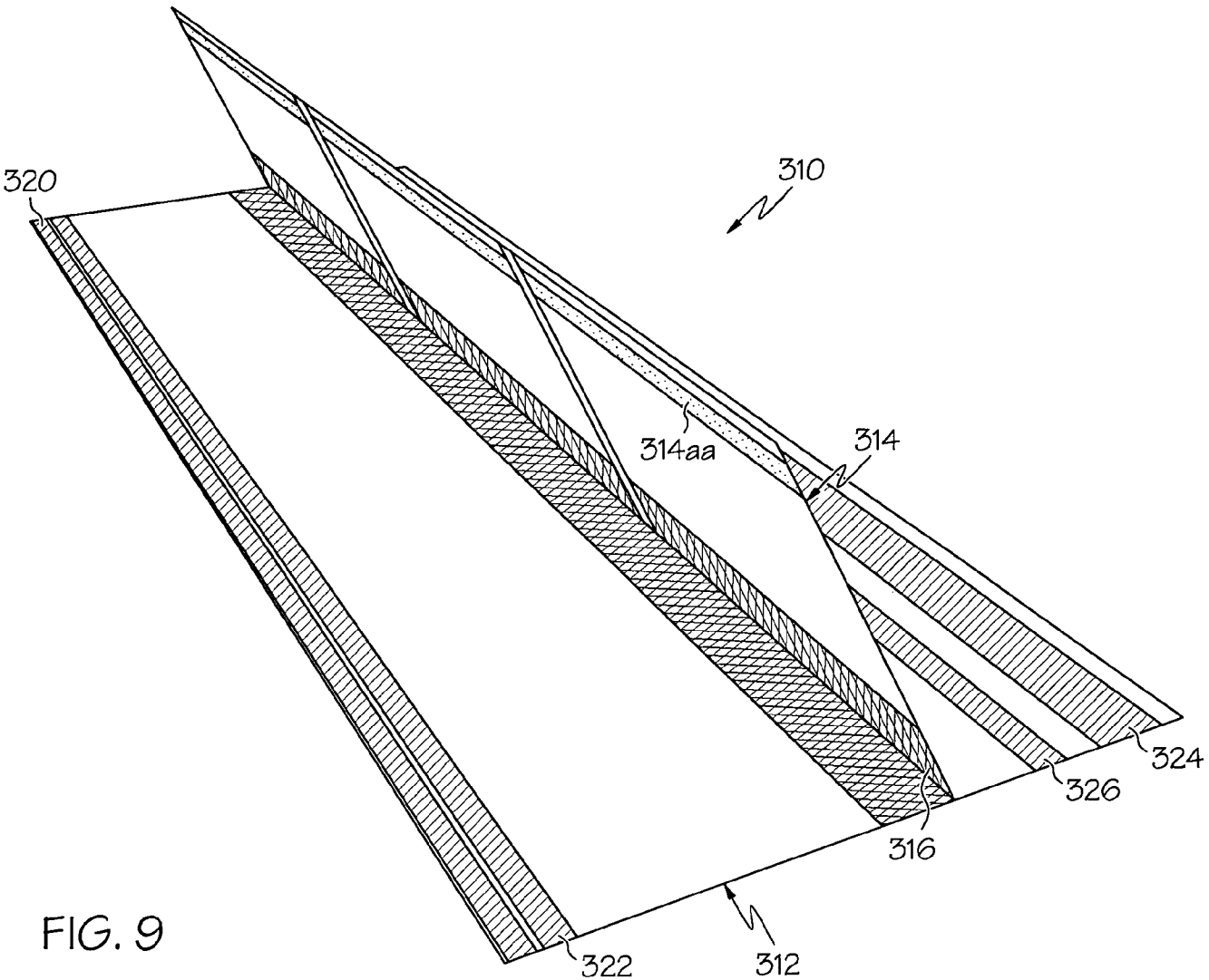
FIG. 9 shows a perspective view of an alternate embodiment of the invention showing a shingle that has a three tab trap lock attached by a strip of flex mesh webbing in which the shingle base layer is constructed from a heat reflecting thermo protective material for additional R value.

FIG. 9 shows another alternate embodiment of the invention that includes a shingle 310 having an upper layer of material 314 permanently attached to the lower layer of material 312. The shingle 310 can include a poly mesh webbing attachment strip 316 that may also have a crease. The alternate embodiment shown in FIG. 9, however, has a base layer 312 that is constructed of a UV and heat reflecting thermo protective insulation material for an added R value. The remaining adhesive strips including 314*aa*, 320, 322, 324 and 326 are similar to those shown with the shingle constructed in accordance with that shown in FIG. 1. Thus, the primary difference is that the shingle 310 shown in FIG. 9 has a bottom layer 312 made out of a heat and UV reflecting thermo protective insulation material. The installation of shingles made in accordance with the alternate embodiment showing shingle 310 and FIG. 9 are installed also in a top down manner using the trap lock system.

Figure 10:
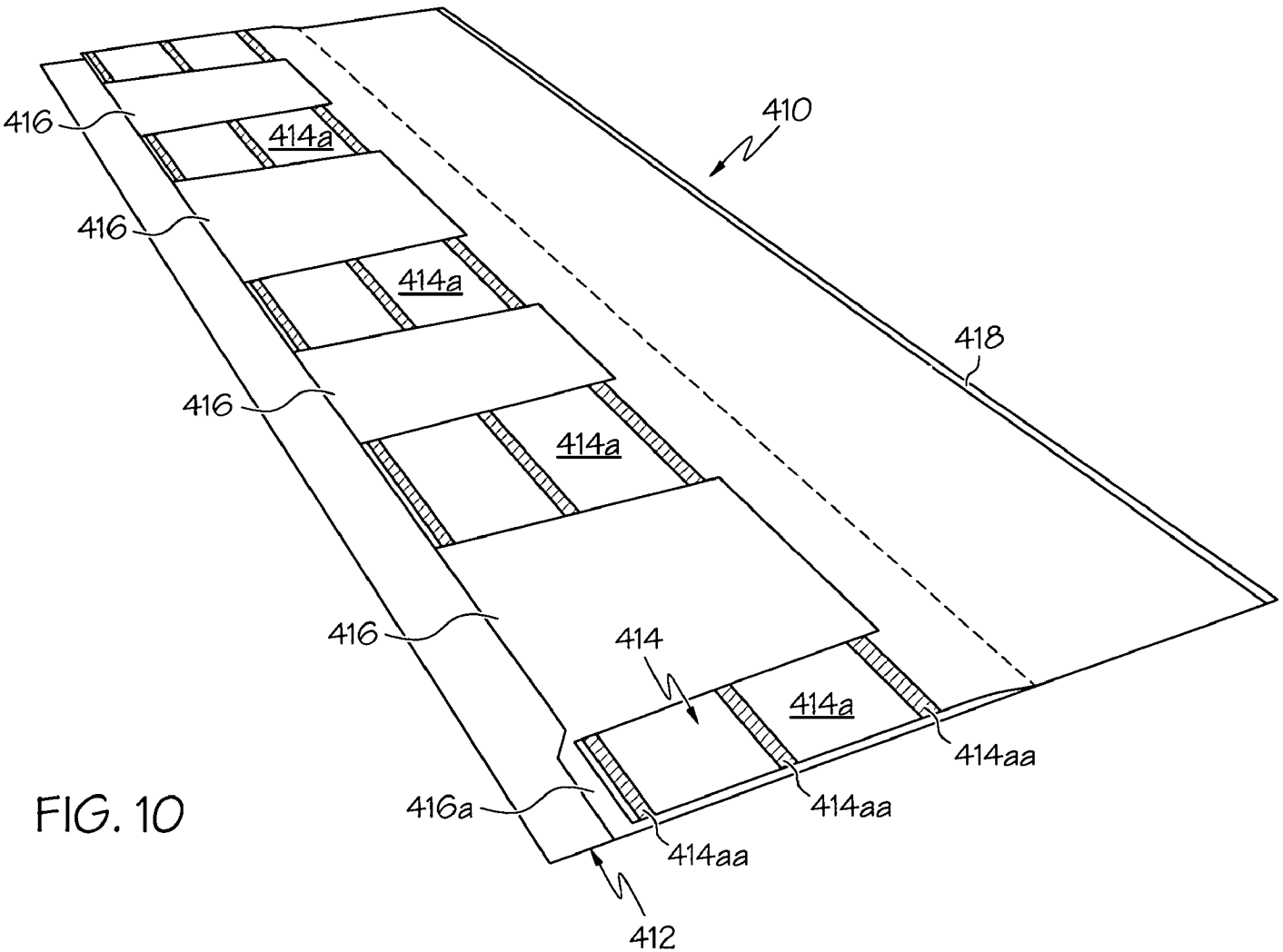
FIG. 10 shows an alternate embodiment of the present invention showing a trap lock shingle in a perspective view that includes an adhesive protective backing paper between the top layer tabs and the bottom layer of the shingle.

Referring now to FIG. 10, another alternate embodiment is shown that includes shingle 410 having an upper layer 414 that includes panels 414*a* having glue strips underneath, a separate adhesive backing paper sheet 416 that separates the bottom layer 412 from upper layer 414 and that protects the adhesive glue strips on the tabs upper panels 414*a* until time of use. A separate sheet release tab 416*a* can be used to start the pull off of the adhesive backing paper 416 which is separate from the shingle at the time of shingle installation when the lower layer 412 of shingles are trap locked into the upper shingle layer 414. An additional adhesive backing paper strip 418 may be utilized along the upper adhesive glue strip at the top of upper layer 414. The glue strips 414*aa* are on the under side facing downward of the tabs 414*a* but are protected by the adhesive backing paper 416 from adhering to lower panel or bottom layer panel 412 until time of use.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A laminated adhesive shingle for use in a roof system comprised of rows of shingles comprising:

a base layer of roofing material including an attachment flange area near its lower edge for attaching the base layer to a roof;

a top layer of roofing material attached to said base layer and permanently attached along its mid section to the top edge of said base layer, said top layer extending along the top edge of said base layer forming a top layer single layer area along the top of the shingle; and said top layer and said base layer delimiting a pocket recess between at least a portion of the top layer and the bottom layer, said pocket recess sized to receive a single layer area of another said shingle when the shingles are interlocked and trap locked between adjacent rows when installed on a roof; and wherein said top layer and said bottom layer are hinged together defining a hinge joint comprising flexible webbing bonded to a bottom portion of said top layer and bonded to a top portion of said bottom layer.

2. A shingle as in claim 1, wherein:

said top layer including at least one adhesive band on its lower side.

3. A shingle as in claim 1, wherein:

said bottom layer having a top adhesive band exposed along its bottom edge that is not covered by the top layer and an adhesive zone on its bottom side along the bottom edge of said base layer.

4. A shingle as in claim 1, where:

said base layer and said top layer are made of an a composite material.

5. A shingle as in claim 1, where:

said base layer and said top layer are made of an asphalt material.

6. A shingle as in claim 1, wherein:

said top layer extending approximately one-third the distance along the top edge of said base layer forming a top layer single layer band along the top of the shingle.

7. A shingle as in claim 1, wherein:

the surface area on the bottom side of said base layer comprises an adhesive coating which is protected by a peel-and-stick film thereby eliminating the need for nails.

8. A shingle as in claim 1, wherein:

the bottom layer is constructed of a UV reflectant, thermo resistant insulation material to increase the R value.

9. A building exterior roof system for protecting the roof from rain and other deleterious weather elements, said roof system being comprised of a plurality of individual shingles interlocked and fastened to the exterior roof surface, each of said individual shingles comprising:

a bottom layer of a pre-determined length measured from the bottom edge to the top edge;

a top layer attached to the upper edge of said bottom layer permanently and having an upper edge area sized in length to fit in a pocket formed between said top layer and said bottom layer wherein shingles in different rows can be interlocked together with the upper layer of a lower row shingle being interlocked in said pocket formed between the middle and bottom layer of an upper row shingle; and wherein said top layer and said bottom layer are hinged together defining a hinge joint comprising flexible webbing bonded to a bottom portion of said top layer and bonded to a top portion of said bottom layer.

10. A roofing shingle system that is fastened to a roof for protecting the roof from water intrusion comprising:

an array of individual shingles each shingle having a top layer and a bottom layer, said bottom layer extending below said top layer providing a fastening area, wherein said top layer and said bottom layer are hinged together defining a hinge joint comprising flexible webbing bonded to a bottom portion of said top layer and bonded to a top portion of said bottom layer, and said shingles laid in rows and interlocked in a top down fashion from row to row comprising:

a roof;

a first row of shingles fastened to said roof within said fastening area along the lower edge of said shingles;

a lower row of shingles each of which is interlocked along its upper edge with the above row of shingles between at least two layers on said upper shingle and fastened along its lower edge in said fastener area so that subsequent rows from top down are all interlocked together and the fasteners covered by the lower rows of shingles.

* * * * *